US005378351A

United States Patent [19]

Guichard et al.

[11] Patent Number: 5,378,351

[45] Date of Patent: Jan. 3, 1995

[54] PROCESS FOR THE PREPARATION OF LUBRICATING BASE OILS

[75] Inventors: Philippe Guichard; Pierre Grandvallet; Guy Barre, all of Grand Couronne, France; Arend Hoek; Andries Q. M. Boon, both of Amesterdam, Netherlands

[73] Assignee: Shell Oil Company, Houston, Tex.

[21] Appl. No.: 143,810

[22] Filed: Oct. 27, 1993

[30] Foreign Application Priority Data

Oct. 28, 1992 [EP] European Pat. Off. ..... 92402938.2

[51] Int. Cl.[6] ..... C10G 45/00; C10G 47/04; C10G 47/06; C10G 47/16

[52] U.S. Cl. ..... 208/143; 208/112; 208/109; 208/18

[58] Field of Search ..... 208/143, 112, 109, 18

[56] References Cited

U.S. PATENT DOCUMENTS 3,763,033 10/1973 Stauffer et al. ..... 208/80
3,941,680 3/1976 Bryson et al. ..... 208/80
4,510,043 4/1985 Oleck et al. ..... 208/97
4,622,129 11/1986 Bayle et al. ..... 208/18
4,837,193 6/1989 Akizuki et al. ..... 502/258

FOREIGN PATENT DOCUMENTS 1493620 11/1977 United Kingdom .
1546398 5/1979 United Kingdom .

*Primary Examiner*—Christine Skane
*Assistant Examiner*—Patricia Hailey
*Attorney, Agent, or Firm*—Timothy J. Hadlock

[57] ABSTRACT

A process for the preparation of a lubricating base oil including contacting a hydrocarbon feed with a catalyst in the presence of hydrogen, which catalyst includes a hydrogenation component supported on an amorphous silica-alumina carrier having a macroporosity in the range of from 5% vol to 50% vol. The hydrocarbon feed is most preferably a slack wax or a synthetic wax. The preferred catalyst for use in the process includes a combination of one or more of the metals cobalt, iron, and nickel, and one or more of the metals chromium, molybdenum, and tungsten on an amorphous silica-alumina carrier having a macroporosity in the range of from 5% vol to 50% vol.

15 Claims, No Drawings

PROCESS FOR THE PREPARATION OF LUBRICATING BASE OILS

I. FIELD OF THE INVENTION

The present invention is directed to a process for the preparation of lubricating base oils. In one embodiment the process includes catalytic conversion of a hydrocarbon feedstock in the presence of hydrogen.

II. BACKGROUND OF THE INVENTION

Lubricating base oils used in the formulation of engine lubricants and industrial oils may be prepared from suitable hydrocarbon feedstocks derived during the refining of crude oil.

In the conventional manufacture of lubricating base oils, the residue remaining after the atmospheric distillation of crude oil (often referred to as "long residue") is further refined using vacuum distillation techniques. Typical products of the vacuum distillation are spindle oil, light machine oil, medium heavy machine oil and a residue (often referred to as "short residue"). A typical process for the preparation of lubricating base oils includes subjecting the spindle oil, light machine oil and medium heavy machine oil to further processing in which undesired aromatic compounds are removed by solvent extraction using furfural or phenol as the solvent. The resulting fractions are then subjected to a catalytic treatment in the presence of hydrogen, after which the fractions are subjected to a dewaxing operation to yield the final lubricating base oil. The short residue may be subjected to a deashpalting treatment and the resulting hydrocarbon stream used as a feed for the aforementioned catalytic treatment.

During the catalytic treatment, the hydrocarbon feed is contacted with a suitable catalyst in the presence of hydrogen. Typical reactions occurring during this treatment are hydrogenation reactions, hydrodesulfurization, hydrodenitrogenation, and some hydrocracking, yielding lower molecular weight hydrocarbons. Most importantly, however, wax molecules in the feed are subjected to hydroisomerization reactions, leading to lubricating base oils having improved viscometric properties, in particular higher viscosity indexes. An ideal catalyst for use in the catalytic treatment would promote the hydroisomerization reactions, while minimizing the hydrocracking reactions, thereby resulting in a lubricating base oil having a desirable viscosity index in a high yield.

Catalysts suitable for use in the catalytic treatment combine a hydrogenation component and an acid component. Suitable catalysts are known in the art. For example, most suitable catalysts for use in this treatment are disclosed in British Patent Nos. 1,493,620 (GB 1,493,620) and 1,546,398 (GB 1,546,398). GB 1,493,620 discloses a catalyst comprising nickel and tungsten as hydrogenation components, supported on an alumina carrier. GB 1,546,398 discloses a catalyst comprising, as a hydrogenation component, nickel and/or cobalt in combination with molybdenum, supported on an alumina carrier. In both GB 1,493,620 and GB 1,546,398 the required acidity for the catalyst is provided by the presence of fluorine.

III. SUMMARY OF THE INVENTION

It has now been found that catalysts, including a hydrogenation component supported on an amorphous silica-alumina carrier, are particularly suitable for use in the aforementioned catalytic treatment. The amorphous silica-alumina carrier is acidic by nature. Accordingly, it is not necessary for the performance of the catalyst that a halogen, such as fluorine, be present. However, it has been found that, in order to achieve a lubricating base oil having the desired viscosity index in a high yield, the amorphous silica-alumina must have a certain pore size distribution. In particular, it has been found that the amorphous silica-alumina carrier should have a certain macroporosity, that is, a substantial portion of the total pore volume of the carrier should be in pores of high diameter.

IV. DESCRIPTION OF THE PREFERRED EMBODIMENTS

The preparation of extra high viscosity index lubricating base oils may be performed by subjecting the wax stream produced during the dewaxing of the hydrocarbon product of the catalytic treatment to a further catalytic treatment in the presence of hydrogen. Most surprisingly, it has been found that the aforementioned catalysts, comprising a hydrogenation component supported on a macroporous amorphous silica-alumina carrier, are particularly selective in the preparation of an extra high viscosity index lubricating base oil in such a process.

Accordingly, the present invention provides a process for the preparation of a lubricating base oil, which process includes contacting a hydrocarbon feed with a catalyst in the presence of hydrogen, which catalyst includes a hydrogenation component supported on an amorphous silica-alumina carrier having a macroporosity in the range of from about 5% vol to about 50% vol.

Typical hydrocarbon materials for use as feed to the process of this invention include any waxy distillate boiling in the range of spindle oils, light machine oils, medium heavy machine oils and deasphalted oils. The aforementioned distillates may, if desired, be subjected to a solvent extraction treatment, for example, extraction with furfural, prior to being used as feed for the process. Slack waxes derived from dewaxing operations are very suitable for use as feeds for the process. In addition, synthetic waxes, such as those prepared by a Fischer-Tropsch synthesis, may also be used. The process of the present invention has been found most suitable for use in the preparation of an extra high viscosity index lubricating base oil, that is a base oil having a viscosity index typically greater than 135, from a slack wax feed or a synthetic wax feed.

The process is conducted at elevated temperature and pressure. Typical operating temperatures for the process are in the range of from about 290° C. to about 430° C., preferably in the range of from about 310° C. to about 415° C., more preferably in the range of from about 325° C. to about 400° C. Typical operating pressures are in the range of from about 80 bar to about 200 bar, preferably in the range of from about 90 bar to about 160 bar, in particular in the range of from about 100 bar to about 150 bar. The hydrocarbon feed is typically treated at a weight hourly space velocity in the range of from about 0.5 kg/l/h to 1.5 kg/l/h, more preferably in the range of from 0.5 kg/l/h to 1.2 kg/l/h.

The feed may be contacted with the catalyst in the presence of pure hydrogen. Alternatively, it may be more convenient to use a hydrogen-containing gas, typically containing greater than 50% vol hydrogen, more preferably greater than 60% vol hydrogen. A suitable hydrogen-containing gas is gas originating from a catalytic reforming plant. Hydrogen-rich gases from other hydrotreating operations may also be used. The hydrogen-to-oil ratio is typically in the range of from 300 to 5000 l/kg, preferably from 500 to 2500 l/kg, more preferably 500 to 2000 l/kg, the volume of hydrogen being expressed as standard liters at 1 bar and 0° C.

Catalysts for use in the process of the present invention include a hydrogenation component supported on an amorphous silica-alumina carrier. Suitable hydrogenation components are the metals of Groups VIB and VIII of the Periodic Table of the Elements, or sulfides or oxides thereof. Preference is given to catalysts comprising as the hydrogenation component one or more of the metals molybdenum, chromium, tungsten, platinum, palladium, nickel, iron and cobalt, or their oxides and/or sulfides.

For use in processes in which hydrocarbon feeds comprising substantial amounts of nitrogen- and sulfur-containing compounds are used, catalysts comprising combinations of one or more of the metals cobalt, iron and nickel, and one or more of the metals chromium, molybdenum and tungsten are preferred. Especially preferred catalysts for use in treating such feeds include, in combination, cobalt and molybdenum, nickel and tungsten, and nickel and molybdenum. The catalysts are preferably used in their sulfidic form. Sulfidation of the catalyst may be effected by any of the techniques known in the art. For example, sulfidation may be effected by contacting the catalyst with a sulfur-containing gas, such as a mixture of hydrogen and hydrogen sulfide, a mixture of hydrogen and carbon disulfide or a mixture of hydrogen and a mercaptan, such as butylmercaptan. Alternatively, sulfidation may be carried out by contacting the catalyst with hydrogen and a sulfur-containing hydrocarbon oil, such as sulfur-containing kerosene or gas oil. The sulfur may also be introduced into the hydrocarbon oil by the addition of a suitable sulfur-containing compound, for example, dimethyldisulfide or tertiononylplosulfide. The amounts of metals present in the catalyst may vary between very wide limits. Typically, the catalyst includes from 10 to 100 parts by weight of the Group VIB metal, if present, preferably from 25 to 80 parts weight, per 100 parts by weight of carrier. The Group VIII metal is typically present in an amount of from 3 to 100 parts by weight, more preferably from 25 to 80 parts by weight, per 100 parts by weight of carrier.

Catalysts for use in the treatment of hydrocarbon feeds which contain low concentrations of nitrogen- and sulfur-containing compounds may include platinum and/or palladium as the hydrogenation component, with platinum being a particularly suitable metal for inclusion in catalysts for such use. Platinum and palladium are typically present in the catalyst in amounts of from 0.05 to 5.0 parts by weight, preferably from 0.1 to 2.0 parts by weight, more preferably from 0.2 to 1.0 parts by weight, per 100 parts by weight of carrier.

The carrier for the catalyst is amorphous silica-alumina. The term "amorphous" indicates a lack of crystal structure, as defined by X-ray diffraction, in the carrier material, although some short range ordering may be present. Amorphous silica-alumina suitable for use in preparing the catalyst is available commercially. Alternatively, the silica-alumina may be prepared by precipitating an alumina and a silica hydrogel and subsequently drying and calcining the resulting material, as is well known in the art.

The catalyst may include any suitable amorphous silica-alumina. The amorphous silica-alumina preferably contains alumina in an amount in the range of from 5% to 75% by weight, more preferably from 10% to 60% by weight. A very suitable amorphous silica-alumina product for use as the carrier includes 45% by weight silica and 55% by weight alumina and is commercially available (ex. Criterion Catalyst Company, U.S.A.).

The amorphous silica-alumina carrier of the catalyst used in the process of this invention has a macroporosity in the range of from 5% vol to 50% vol. For the purposes of this specification, the term "macroporosity" means the fraction of the total pore volume of the carrier present in pores with a diameter greater than 35 nm. References to the total pore volume are to the pore volume determined using the Standard Test Method for Determining Pore Volume Distribution of Catalysts by Mercury Intrusion Porosimetry, ASTM D 4284-88, at a maximum pressure of 4000 bar, assuming a surface tension for mercury of 484 dyne/cm and a contact angle with amorphous silica-alumina of 140° . Preferably, the carrier has a macroporosity of at least 10% vol, more preferably at least 15% vol. Especially preferred catalysts for use in the process include a carrier having a macroporosity of at least 20% vol.

Catalysts comprising carriers having a high macroporosity may suffer the disadvantage of the catalyst having a low resistance to damage by crushing. Accordingly, the macroporosity is preferably no greater than 40% vol, more preferably no greater than 35% vol. The side crushing strength of the catalyst is suitably above 75 N/cm, more preferably above 100 N/cm.

In addition to amorphous silica-alumina, the carrier may also include one or more binder materials. Suitable binder materials include inorganic oxides. Both amorphous and crystalline binders may be applied. Examples of binder materials include silica, alumina, clays, magnesia, titania, zirconia and mixtures thereof. Silica and alumina are preferred binders, with alumina being especially preferred. The binder, if incorporated in the catalyst, is preferably present in an amount of from 5% to 50% by weight, more preferably from 15% to 30% by weight, on the basis of total weight of the carrier. Catalysts comprising a carrier without a binder are preferred for use in the process of this invention.

The catalyst for use in the process of the present invention may be prepared by any of the suitable catalyst preparation techniques known in the art.

The carrier may be prepared from the amorphous silica-alumina starting material by methods known to the person skilled in the art. A preferred method for the preparation of the carrier includes mulling a mixture of the amorphous silica-alumina and a suitable liquid, extruding the mixtures and drying the resulting extrudates.

The mixture to be extruded should, preferably, have a solids content in the range of from 20 to 60% by weight.

The liquid for inclusion in the mixture may be any of the suitable liquids known in the art. Examples of suitable liquids include water; alcohols, such as methanol, ethanol and propanol; ketones, such as acetone; aldehydes, such as propanal; and aromatic liquids, such as toluene. A most convenient and preferred liquid is water.

To obtain strong extrudates, the mixture preferably includes a peptizing agent. Suitable peptizing agents are acidic compounds, for example, inorganic acids such as aqueous solutions of hydrogen fluoride, hydrogen bromide and hydrogen chloride, nitric acid, nitrous acid and perchloric acid. Preferably, the peptizing agent is an organic acid, for example, a mono- or dicarboxylic acid. Preferred organic acids include acetic acid, propionic acid and butanoic acid. Acetic acid is a most preferred acidic peptizing agent. Alternatively, peptizing may be effected using a basic peptizing agent. Suitable basic peptizing agents include organic bases, such as fatty amines, quaternary ammonium compounds, alkyl ethanol amines and ethoxylated alkyl amines. Alternatively, inorganic bases, such as ammonia, may be used. Monoethanol amine and ammonia are particularly suitable basic peptizing agents.

The amount of peptizing agent included in the mixture should be sufficient to fully peptize the alumina present in the carrier material. The amount can be readily determined by the pH of the mixture. During mulling, the pH of the mixture should preferably lie in the range of from 1 to 6, more preferably from 4 to 6, when using an acidic peptizing agent, and in the range of from 8 to 10, when using a basic peptizing agent.

To improve the flow properties of the mixture, it is preferred to include one or more flow improving agents and/or extrusion aids in the mixture prior to extrusion. Suitable additives for inclusion in the mixture include aliphatic mono-carboxylic acids, polyvinyl pyridine, and sulfoxonium, sulfonium, phosphonium and iodonium compounds, alkylated aromatic compounds, acyclic monocarboxylic acids, fatty acids, sulfonated aromatic compounds, alcohol sulfates, ether alcohol sulfates, sulfated fats and oils, phosphonic acid salts, polyoxyethylene alkylphenols, polyoxyethylene alcohols, polyoxyethylene alkylamines, polyoxyethylene alkylamides, polyacrylamides, polyols and acetylenic glycols. Preferred agents are sold under the trademarks Nalco and Superfloc.

The flow improving agents/extrusion aids are preferably present in the mixture in a total amount in the range of from 1% to 20% by weight, more preferably from 2% to 10% by weight, on the basis of the total weight of the mixture.

In principle, the components of the mixture may be combined in any order, and the mixture mulled. Preferably, the amorphous silica-alumina and the binder, if present, are combined and the mixture mulled. Thereafter, the liquid and, if present, the peptizing agent, are added and the resulting mixture further mulled. Finally, any flow improving agents/extrusion aids to be included are added and the resulting mixture mulled for a final period of time.

Typically, the mixture is mulled for a period of from 10 to 120 minutes, preferably from 15 to 90 minutes. During the mulling process, energy is input into the mixture by the mulling apparatus. The rate of energy input into the mixture is typically from 0.05 to 50 Wh/min/kg, preferably from 0.5 to 10 Wh/min/kg. The mulling process may be carried out over a broad range of temperature, preferably from 15° C. to 50° C. As a result of the energy input into the mixture during the mulling process, there will be a rise in the temperature of the mixture during the mulling. The mulling process is conveniently carried out at ambient pressure. Any suitable, commercially available mulling apparatus may be employed.

Once the mulling process has been completed, the resulting mixture is then extruded. Extrusion may be effected using any conventional, commercially available extruder. In particular, a screw-type extruding machine may be used to force the mixture through orifices in a suitable dieplate to yield extrudates of the desired form. The strands formed upon extrusion may be cut to the desired length.

The extrudates may have any suitable form known in the art, for example, cylindrical, hollow cylindrical, multilobed or twisted multilobed. A most suitable shape for the catalyst particles is cylindrical. Typically, the extrudates have a nominal diameter of from 0.5 to 5 mm, preferably from 1 to 3 mm.

After extrusion, the extrudates are dried. Drying may be effected at an elevated temperature, preferably up to 800° C., more preferably up to 300° C. The period for drying is typically up to 5 hours, preferably from 30 minutes to 3 hours.

Preferably, the extrudates are calcined after drying. Calcination is effected at an elevated temperature, preferably up to 1000° C., more preferably from 200° C to 1000° C., most preferably from 300° C. to 800° C. Calcination of the extrudates is typically effected for a period of up to 5 hours, preferably from 30 minutes to 4 hours.

Once the carrier has been prepared, the hydrogenation component may be deposited onto the carrier material. Any of the suitable methods known in the art may be employed, for example, ion exchange, competitive ion exchange, comulling and impregnation. A most preferred method is impregnation, in which the carrier is contacted with a compound of the hydrogenation component in the presence of a liquid.

A preferred impregnation technique for use in the process of the present invention is the pore volume impregnation technique, in which the carrier is contacted with a solution of the hydrogenation component, the solution being present in a sufficient volume so as to substantially just fill the pores of the carrier material. A convenient method for effecting impregnation is by spraying the carrier with the requisite quantity of the solution.

After impregnation, the resulting catalyst is preferably dried and preferably calcined. The conditions for drying and calcining are as set out hereinbefore.

If the catalyst is to include more than one hydrogenation component, the carrier may be impregnated with each component in turn, or may be impregnated with all the hydrogenation components simultaneously.

In a second aspect, the present invention provides the use of a catalyst comprising a hydrogenation component supported on an amorphous silica-alumina carrier having a macroporosity in the range of from 5% vol to 50% vol in a process for the preparation of a lubricating base oil, which process includes contacting a hydrocarbon feed with a catalyst in the presence of hydrogen.

According to a further aspect of this invention, there is provided a catalyst comprising a combination of one or more of the metals cobalt, iron, and nickel, and one or more of the metals chromium, molybdenum, and tungsten on an amorphous silica-alumina carrier having a macroporosity in the range of from 5% vol to 50% vol. This catalyst is particularly advantageous when applied in the process of the present invention to prepare lubricating base oils from hydrocarbon feeds comprising significant amounts of nitrogen- and sulfur-containing compounds.

The hydrocarbon product of the process of the present invention may be further treated using techniques known in the art to recover the desired lubricating base oil. Thus, the hydrocarbon product may be subjected to a redistillation stage. Further processing may include a dewaxing stage, either using solvent or catalytic dewaxing techniques. Further processing steps, such as hydrofinishing, may also be applied.

Solvent dewaxing may be carried out using two solvents, the first to dissolve the oil and maintain the fluidity of the hydrocarbon product at low temperatures (methyl isobutyl ketone and toluene being well known solvents for such use) and the second to act as a precipitating agent at low temperatures (methyl ethyl ketone being well known for such application). Typically, solvent dewaxing proceeds by mixing the hydrocarbon product with the solvents while heating, to ensure solution. The resulting mixture is then cooled, typically to a temperature in the range of from −10° C. to −40° C., and filtered to remove the precipitated wax. The solvents may be recovered from the dewaxed oil and the wax and recirculated.

Catalytic dewaxing is typically carried out by contacting the hydrocarbon product in the presence of hydrogen with a suitable catalyst. Suitable catalysts include crystalline aluminum silicates, such as ZSM-5 and related compounds, for example, ZSM-8, ZSM-1, ZSM-23 and ZSM-35. The catalytic dewaxing may be carried out at temperatures in the range of from 200° C. to 500° C., hydrogen pressure of from 5 to 100 bar, a hydrocarbon weight hourly space velocity of from 0.1 to 5.0 kg/l/h and a hydrogen-to-oil ratio of from 100 to 2500 l/kg, the volume of hydrogen being expressed as standard liters at 1 bar and 0° C.

The lubricating base oil produced by the process of the present invention is most suitable for application in the formulation of lubricating oils for many applications, if desired in combination with one or more additives and/or base oil fractions obtained via other processes.

V. ILLUSTRATIVE EXAMPLES

The present invention will be further described with reference to the following illustrative examples.

EXAMPLE 1

A catalyst sample, A, was prepared using the following general procedure:

Amorphous silica-alumina (45% wt silica, 55% wt alumina, ex. Criterion Catalyst Company,) and acetic acid (aqueous solution, sufficient to give 6% wt acetic acid on basis of silica-alumina) were combined. Sufficient water was added to give a loss on ignition at 600° C. of 60% wt and the resulting mixture mulled for a period of 40 minutes. Extrusion aid (Superfloc A 1839, 3% wt on basis of silica-alumina) was added and the resulting mixture mulled for a further 5 minutes. The resulting mixture was extruded using a 1" Bonnot extruder with a 1.6 mm cylindrical dieplate insert. The resulting extrudates were dried and thereafter calcined at a temperature of 565° C. for a period of 3 hours.

Two further samples, B and C, were prepared using the above-described general procedure, but varying the amount of water and acetic acid in the mixture being mulled in order to vary the macroporosity of the eventual extrudates.

Each of the three samples was impregnated with an aqueous solution of nickel nitrate hexahydrate and ammonium metatungstate using the incipient wetness technique. The thus impregnated carriers were then dried at 200° C. for 2 hours and subsequently calcined at 500° C. for 2 hours. The resulting catalysts each included 5% wt nickel (6.3% wt NiO) and 23% wt tungsten (30% wt $WO_3$). Each catalyst sample was subsequently sulfided using a gasoil containing dimethyldisulfide.

Each sample was tested for performance in the preparation of a lubricating base oil using the following general procedure:

The catalyst was loaded into a reactor and retained as a fixed bed. A slack wax, having the characteristics set out in Table 1 below, was fed to the reactor at a weight hourly space velocity of 1.0 kg/l/h. Hydrogen was fed to the reactor at an inlet pressure of 140 bar and at a flowrate of 1500 Nl/h. The reaction temperature in each case was adjusted to achieve a wax conversion of 80% wt. A temperature of 383° C., 387° C. and 391° C. was required for catalysts A, B and C respectively.

TABLE 1

| Slack Wax Feedstock | |
|---|---|
| Specific Gravity at 70° C. | 0.8102 |
| Nitrogen content (mg/kg) | 14 |
| Sulfur content (mg/kg) | 380 |
| Viscosity at 100° C. (cst) | 6.98 |
| Wax content (390 + °C.) (% wt) (solvent dewaxing at −27° C.) | 65.2 |
| Initial Boiling Point (°C.) | 337 |
| % wt recovered at | |
| 370° C. | 2.6 |
| 390° C. | 3.8 |
| 470° C. | 38.0 |
| 510° C. | 62.5 |
| >510° C. | 37.5 |

The hydrocarbon product was distilled to remove that fraction of the product having a boiling point below 390° C. and further refined by solvent dewaxing at a temperature of −27° C. The remaining oil was collected, the yield of oil (expressed as % wt of the feed) for each catalyst tested being given in Table 2 below.

TABLE 2

| Yield of Lubricating Base Oil | | |
|---|---|---|
| Catalyst | Macroporosity[1] (% vol) | Yield (% wt) |
| A | 1.4 | 33.0 |
| B | 11.9 | 37.5 |
| C | 22.3 | 42.0 |

[1]Determined by ASTM method D 4284-83.

We claim:

1. A process for the preparation of an extra high viscosity index lubricating base oil, said viscosity index being greater than 135, which process comprises contacting in a contacting zone a hydrocarbon feed with a catalyst in the presence of hydrogen, which catalyst consists essentially of a hydrogenation component selected from the group consisting of cobalt, iron, and nickel or their oxides and/or sulfides, in combination with chromium, molybdenum, and tungsten, or their oxides or their sulfides, supported on an amorphous silica-alumina carrier having a macroporosity of at least 20% vol and wherein said catalyst has a side crushing strength greater than 75 N/cm and wherein said catalyst is substantially halogen-free.

2. The process according to claim 1, wherein the catalyst is halogen-free.

3. The process according to claim 2, wherein the carrier has macroporosity no greater than 40% vol.

4. The process according to claim 3, wherein the amorphous silica-alumina carrier comprises alumina in an amount in the range of from about 10% by weight to about 75% by weight.

5. The process according to claim 2, wherein the hydrogenation component is selected from the group consisting of molybdenum, chromium, tungsten, platinum, nickel, iron and cobalt, or their oxides or sulfides.

6. The process according to claim 2, wherein the hydrogenation component is selected from the group consisting of cobalt, iron and nickel or their oxides and/or sulfides, in combination with chromium, molybdenum and tungsten, or their oxides or their sulfides.

7. The process according to claim 2, wherein the operating temperature is in the range of from about 290° C. to about 430° C.

8. The process according to claim 7, wherein the operating temperature is in the range of from about 310° C. to about 415° C.

9. The process according to claim 7, wherein the operating pressure is in the range of from about 80 bar to about 200 bar.

10. The process according to claim 9, wherein the operating pressure is in the range of from about 100 bar to about 150 bar.

11. The process according to claim 2, wherein the hydrocarbon feed is processed at a weight hourly space velocity in the range of from about 0.5 kg/l/h to about 1.5 kg/l/h.

12. The process according to claim 2, further comprising providing hydrogen to the contacting step in an amount to give a hydrogen-to-feed ratio of from about 300 l/kg to about 5000 l/kg, wherein the volume of hydrogen as expressed as standard liters at 1 bar and 0° C.

13. The process according to claim 12, further comprising providing hydrogen to the contacting step in an amount to give a hydrogen-to-feed ratio of from about 500 l/kg to about 2500 l/kg, wherein the volume of hydrogen as expressed as standard liters at 1 bar and 0° C.

14. The process according to claim 2, wherein the hydrocarbon feed is selected from the group consisting of a spindle oil, a light machine oil, a medium heavy machine oil, a deasphalted oil, a slack wax, a synthetic wax, and admixtures thereof.

15. A process for the preparation of an extra high viscosity index lubricating base oil, said viscosity index being greater than 135, which process comprises contacting in a contacting zone, at a pressure from about 100 bar to about 150 bar and at a temperature of from about 310° C. to about 415° C. and a weight hourly space velocity from about 0.5 kg/l/h to about 1.5 kg/l/h, a hydrocarbon feed selected from the group consisting of a spindle oil, a light machine oil, a medium heavy machine oil, a deasphalted oil, a slack wax, a synthetic wax, and admixtures thereof, with a catalyst in the presence of hydrogen wherein the hydrogen is present in an amount to give a hydrogen-to-feed ratio of from about 300 l/kg to about 5000 l/kg, wherein the volume of hydrogen is expressed as standard liters at 1 bar and 0° C., and which catalyst consists essentially of a hydrogenation component selected from the group consisting of cobalt, iron, and nickel or their oxides and/or sulfides, in combination with chromium, molybdenum, and tungsten, or their oxides or their sulfides, supported on an amorphous silica-alumina carrier comprising alumina in an amount of from about 10% by weight to about 60% weight and having a macroporosity in the range of from 20% vol to 40% vol and wherein said catalyst is halogen-free and wherein said catalyst has a side crushing strength greater than 75 N/cm.

* * * * *